US009266655B1

(12) United States Patent
Shook

(10) Patent No.: US 9,266,655 B1
(45) **Date of Patent: *Feb. 23, 2016**

(54) DISPOSABLE YARD DEBRIS BUNDLING DEVICE WITH DRAWSTRINGS

(71) Applicant: Stuart Shook, Coral Springs, FL (US)

(72) Inventor: Stuart Shook, Coral Springs, FL (US)

( * ) Notice: Subject to any disclaimer, the term of this patent is extended or adjusted under 35 U.S.C. 154(b) by 389 days.

This patent is subject to a terminal disclaimer.

(21) Appl. No.: 13/867,541

(22) Filed: Apr. 22, 2013

Related U.S. Application Data

(63) Continuation-in-part of application No. 12/406,994, filed on Mar. 19, 2009, now Pat. No. 8,425,995.

(51) Int. Cl.
*B32B 1/02* (2006.01)
*B65D 65/10* (2006.01)

(52) U.S. Cl.
CPC ..... *B65D 65/10* (2013.01)

(58) Field of Classification Search
CPC ..... B65D 65/10; B65F 1/00; B65F 2240/138; Y10T 428/1334; Y10T 428/24777
USPC ..... 428/35.2, 99, 192; 383/4
See application file for complete search history.

(56) References Cited

U.S. PATENT DOCUMENTS

| | | | | |
|---|---|---|---|---|
| 4,519,183 | A | | 5/1985 | Parody |
| 4,561,480 | A | | 12/1985 | Underwood et al. |
| 4,938,607 | A | | 7/1990 | Kelley |
| 5,069,554 | A | | 12/1991 | Bonnett |
| 5,286,111 | A | | 2/1994 | Brembilla |
| 5,336,124 | A | * | 8/1994 | Garside ..... 452/125 |
| 5,529,321 | A | | 6/1996 | Thompson |
| 5,660,402 | A | | 8/1997 | Jones et al. |
| 5,713,980 | A | | 2/1998 | Tierney |
| 5,834,582 | A | | 11/1998 | Sinclair et al. |
| 5,911,463 | A | | 6/1999 | Fesko |
| 5,943,831 | A | | 8/1999 | Pangburn |
| 6,128,852 | A | | 10/2000 | Hansen |
| 6,267,504 | B1 | | 7/2001 | Screen |
| 6,474,022 | B1 | | 11/2002 | Double et al. |
| 6,565,101 | B2 | | 5/2003 | Jones, Jr. et al. |
| 6,776,178 | B1 | | 8/2004 | Glynn et al. |
| 6,842,921 | B1 | | 1/2005 | Tsiarkezos et al. |
| 6,966,152 | B2 | | 11/2005 | Glynos |
| 7,249,792 | B1 | | 7/2007 | Bunten |
| 2005/0120692 | A1 | | 6/2005 | Kim |
| 2006/0215940 | A1 | | 9/2006 | May |
| 2007/0183690 | A1 | | 8/2007 | Schoenig et al. |
| 2007/0184239 | A1 | | 8/2007 | Mallory |
| 2009/0173460 | A1 | | 7/2009 | Handwerker |
| 2010/0008601 | A1 | | 1/2010 | Prudencio |

* cited by examiner

*Primary Examiner* — Erik Kashnikow
(74) *Attorney, Agent, or Firm* — Malin Haley DiMaggio & Bowen, P.A.

(57) ABSTRACT

A high strength disposable debris bundling device including a sheet-like main body having a plurality of drawstrings running generally parallel and in spaced relation through separate channels associated with the wrap. The drawstrings preferably comprise elongate flexible thin rope or cord-like structures that run through hem channels formed in the wrap and function to compact and secure the debris in bundle with the wrap disposed in surrounding relation therewith. Providing at least two drawstrings allows the wrap to be pulled tightly around the debris and secured in contoured surrounding relation therewith. The wrap preferably has a width of between approximately 3.0 feet and 5.0 feet. Handles are provided to assist in handling the wrapped debris bundle.

4 Claims, 7 Drawing Sheets

DISPOSABLE YARD DEBRIS BUNDLING DEVICE WITH DRAWSTRINGS

CROSS REFERENCE TO RELATED APPLICATIONS

This application is a continuation-in-part of U.S. patent application Ser. No. 12/406,994, filed on Mar. 19, 2009.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction of the patent document or patent disclosure as it appears in the Patent and Trademark Office patent file or records, but otherwise reserves all copyright rights whatsoever.

BACKGROUND OF THE INVENTION

1. Field of the Invention

The present invention relates generally to devices for lawn debris and trash collection and disposal, and more particularly to a disposable plastic debris wrap having a plurality of drawstrings for securing lawn debris and trash in an easy to handle bundled configuration.

2. Description of Related Art

Yard debris, such as leaves and tree trimmings, is typically collected and placed in plastic trash bags for removal and disposal. Trash bags are typically fabricated from lightweight plastic and may include an opening adapted with a drawstring that provides a means for closing the bag. There are, however, a number of disadvantages present with the use of conventional trash bags. One primary disadvantage with the use of conventional trash bags relates to size. More particularly, yard debris often includes long branches or limbs that simply will not fit within the confines of a conventional trash bag. As a result the user must spend additional time and energy cutting the limbs and branches down to a suitable size. Another disadvantage relates to placing the debris into conventional trash bags. The use of conventional trash bags for disposal of yard debris requires that the debris be gathered, lifted, and placed in the bag. Conventional trash bags are typically held with one hand and filled with the other, or may be temporarily placed in a garbage barrel and filled.

As a result of such difficulties, people often forego the use of conventional trash bags and simply bundle branches and limbs using twine or cord. Furthermore, a growing number of cities, municipalities, and waste collection companies encourage bundling of yard debris, and many such entities have adopted waste collection rules that require tree trimmings and branches to be bundled prior to collection and disposal. Waste collection rules commonly limit the size of debris bundles to approximately 4.0 feet in length, and about 40.0 pounds in weight.

The background art reveals a number of devices structured to assist in the collection and disposal of tree trimmings, branches, and other lawn and garden debris. For example, U.S. Patent Application Publication No. US 2007/0183690 A1 issued to Schoenig et al., discloses a planar bag material containment system having a flexible layer for collecting lawn debris and the like. The device includes flaps secured about the perimeter of the material, and a zipper for enclosing the contents. The device further includes handles and pull straps placed externally on the material for securing the load. U.S. Patent Application Publication No. US 2007/0184239 A1 issued to Mallory describes an yard waste storage and disposal system which includes a biodegradable web material having a net attached thereto, along with plurality of longitudinal and lateral net lengths which are twisted, knotted, or woven together. The net is made from jute twine, cord, rope or other biodegradable material. The net includes freely extending ties around the outside of the web, and the net apparatus is glued to the web.

U.S. Pat. No. 4,519,183 issued to Parody illustrates trash collecting device having a flexible fabric or plastic sheet material with ties or strings placed about the perimeter, along with side flaps and ties. Opposite sides of the sheet are made rigid by inserting removable sticks or rods through channel members formed along the edges. The channels can be formed doubling over the edges and sealing, through heat application or adhesive. U.S. Pat. No. 5,713,980 issued to Tierney discloses a flexible composting mat for aerating organic material and yard debris, the mat having netting and handles. A pull handle is incorporated around the outside perimeter to tighten the mat and load into a bag-like configuration. The drawstring can be attached through a channel formed in the periphery. U.S. Patent Application Publication No. US 2005/0120692 A1 issued to Kim discloses a leaf collection woven mesh net of biodegradable fiber material. The device includes stake means, along with a continuous pulling strand extending about the outer perimeter of the net.

While the devices disclosed in the background art are generally acceptable for certain applications, there remains a need for further advancements in the art of debris collection and disposal.

BRIEF SUMMARY OF THE INVENTION

The present invention overcomes the limitations and disadvantages present in the art by providing a high strength disposable debris wrap having a plurality of drawstrings running generally parallel and in spaced relation through separate hem channels formed in the wrap. The drawstrings preferably comprise elongate flexible thin rope or cord-like structures that run through hem channels formed in the wrap and function to compact and secure the debris in bundle with the wrap disposed in surrounding relation therewith. Providing at least 4 drawstrings allows the wrap to be pulled tightly around the debris and secured, by tying the drawstrings together, in contoured surrounding relation therewith. The drawstrings further function to provide added strength. The wrap preferably has a width of approximately 4.0 feet so as to conform to most modern trash removal standards and regulations. With the debris secured in a bundle, the tied together drawstrings further function as handles to allow the user to lift and move the wrapped debris bundle.

Accordingly, it is an object of the present invention to provide a high strength disposable plastic wrap for use in bundling debris, such as tree trimmings, branches, limbs, and leaves.

Another object of the present invention is to provide a debris bundling wrap having a plurality of drawstrings traversing the wrap for use in securing the wrap in contoured surrounding relation with the debris.

Still another object of the present invention is to provide a debris bundling wrap incorporating handles for use in lifting and moving the bundle.

In accordance with these and other objects, which will become apparent hereinafter, the instant invention will now be described with particular reference to the accompanying drawings.

DETAILED DESCRIPTION OF THE INVENTION

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

Unless otherwise defined, all technical and scientific terms used herein have the same meaning as commonly understood by one of ordinary skill in the art to which this invention pertains. In the case of conflict, the present document, including definitions will control. As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated. As used herein, when a number or a range is recited, ordinary skill in the art understand it intends to encompass an appropriate, reasonable range for the particular field related to the invention.

Figure 1:
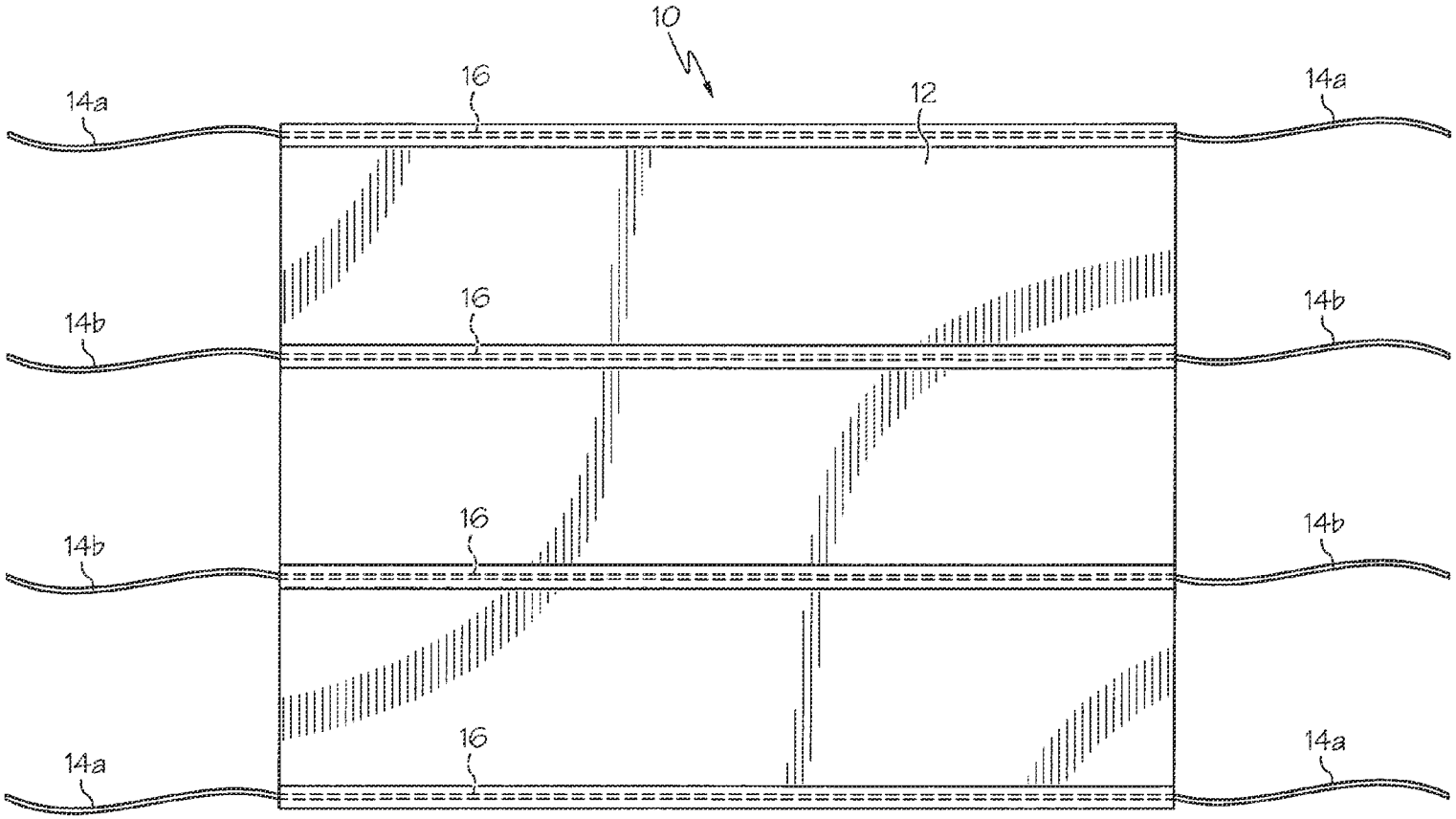
FIG. 1 is a top plan view of a debris bundling wrap in accordance with the present invention.

With reference now to the drawings, FIGS. 1-6 depict preferred and alternate embodiments of a disposable debris wrap, generally referenced as 10, in accordance with the present invention. As best seen in FIGS. 1 and 2A, disposable debris wrap 10 comprises a main body sheet 12 formed of sheet or sheet-like material, preferably a light-weight, high-strength plastic similar or identical to that used in the fabrication of conventional plastic garbage/trash bags. While the preferred embodiment is disclosed as being fabricated from plastic, the present invention contemplates any suitable sheet-like material, including virgin or recycled paper, hessian or burlap, natural or synthetic woven fabric, a suitable polymeric material such as polypropylene, polyethelyne, polyester, or any other suitable material. It is further advantageous that the material used have, or be adapted to include areas having, a high coefficient of static friction to facilitate the staking of a plurality of wrapped bundles in a stable pile. The disposable wrap, and particularly sheet 12, preferably has a width of approximately 4 feet so as to conform to modern trash removal standards and regulations when configured as a bundled load.

Wrap 10 further includes a plurality of drawstrings, referenced as 14*a* and 14*b*, that traverse the length of sheet 12 in generally parallel and spaced relation through separate sleeve-like hems or channels 16 formed on sheet 12 and extend beyond the opposing sides of sheet 12 as best illustrated in FIGS. 1 and 2. In a preferred embodiment, each drawstring 14*a* and 14*b* is movably received within sleeve-like channels 16 so as to allow the user to pull the wrap and surrounding relation with the debris load, and secure the wrap by tying together drawstring ends. Drawstrings 14*a* and 14*b* each preferably comprise an elongate flexible, thin rope or cord-like structures. In an alternate embodiment, drawstrings 14*a* and 14*b* may comprise bands of plastic material, or any other suitable material. In an embodiment wherein sheet 12 is fabricated from plastic, channels 16 may be formed by heat welding or sonic welding the edges of strips of material, referenced as 16*a* and 16*b*, to sheet 12 as illustrated in FIG. 2D. In an embodiment channels 16 may be formed by adhesively securing the edges of strip material to sheet 12, by stitching, or by any other suitable means of attachment.

Figure 2A:
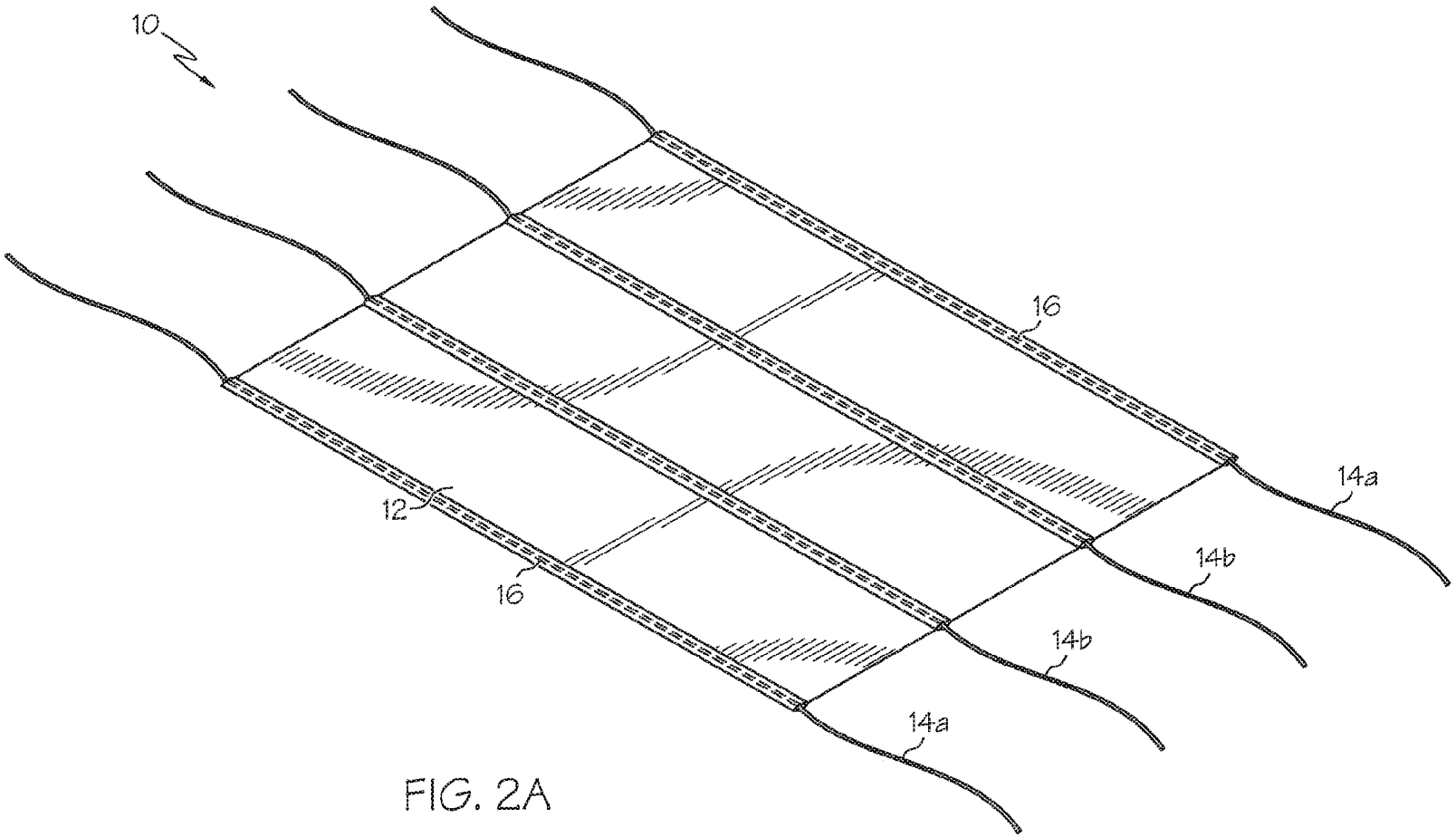
FIG. 2A is a top perspective view thereof.
Figure 2C:
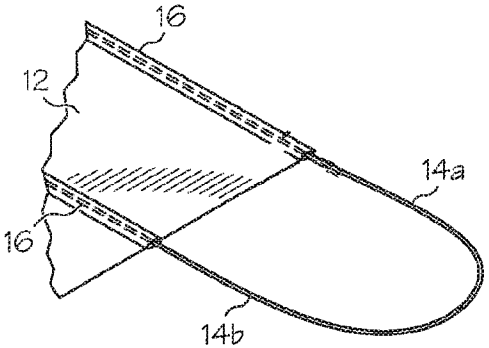
FIG. 2C is a partial detail view of another alternate drawstring configuration.
Figure 2D:
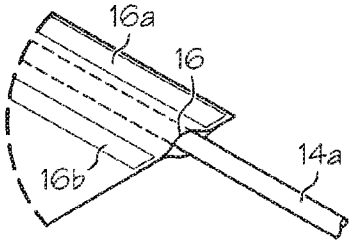
FIG. 2D is a partial detail view of a channel formation.
Figure 2B:
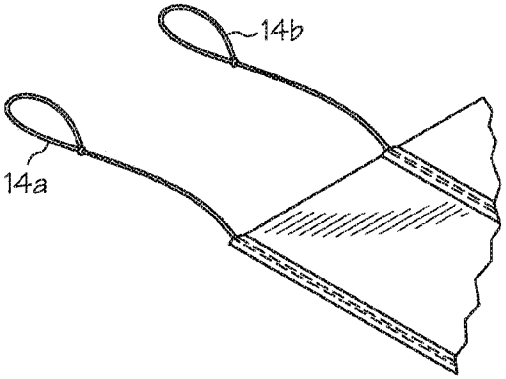
FIG. 2B is a partial detail view of an alternate drawstring configuration.

Wrap 10 is primarily configurable between an open deployed configuration wherein sheet 12 is opened on the ground and a closed bundled configuration wherein sheet 12 is disposed in surrounding relation with the load so as to bundle the load in a generally tubular configuration. A significant aspect of the present invention involves providing a plurality, namely 4, drawstrings in parallel spaced relation so as to allow sheet 12 to compact and conform to the load in the bundled configuration. Pulling on opposing drawstring ends functions to draw opposing ends of sheet 12 together and to compact the load with sheet 12 in contoured surrounding relation therewith. In a preferred embodiment, wrap 10 includes 4 drawstrings, including a pair of outer drawstrings, referenced as 14*a*, disposed at or near opposing peripheral side edges of sheet 12, and inner drawstrings, referenced as 14*b*, disposed in inwardly spaced relation with outer drawstrings 14*a*. Drawstrings 14*a* and 14*b* may include opposing ends each terminating in a loop as illustrated in FIG. 2B to facilitate grasping and bundling. In another contemplated embodiment, adjacent drawstrings 14*a* and 14*b* may be joined at each opposing end as illustrated in FIG. 2C.

Figure 3:
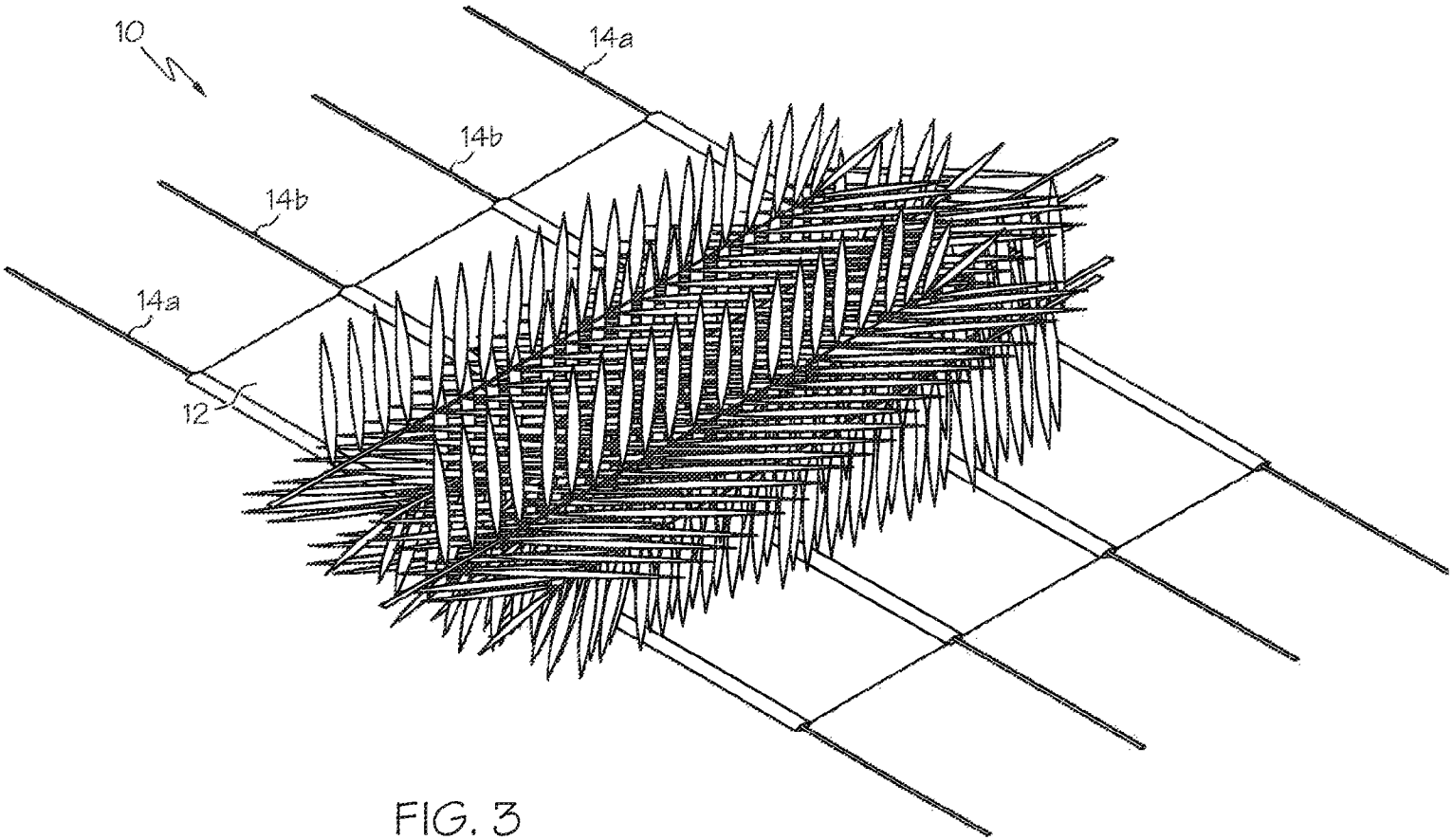
FIG. 3 is a top perspective view illustrating tree trimmings placed on the wrap prior to bundling.
Figure 4:
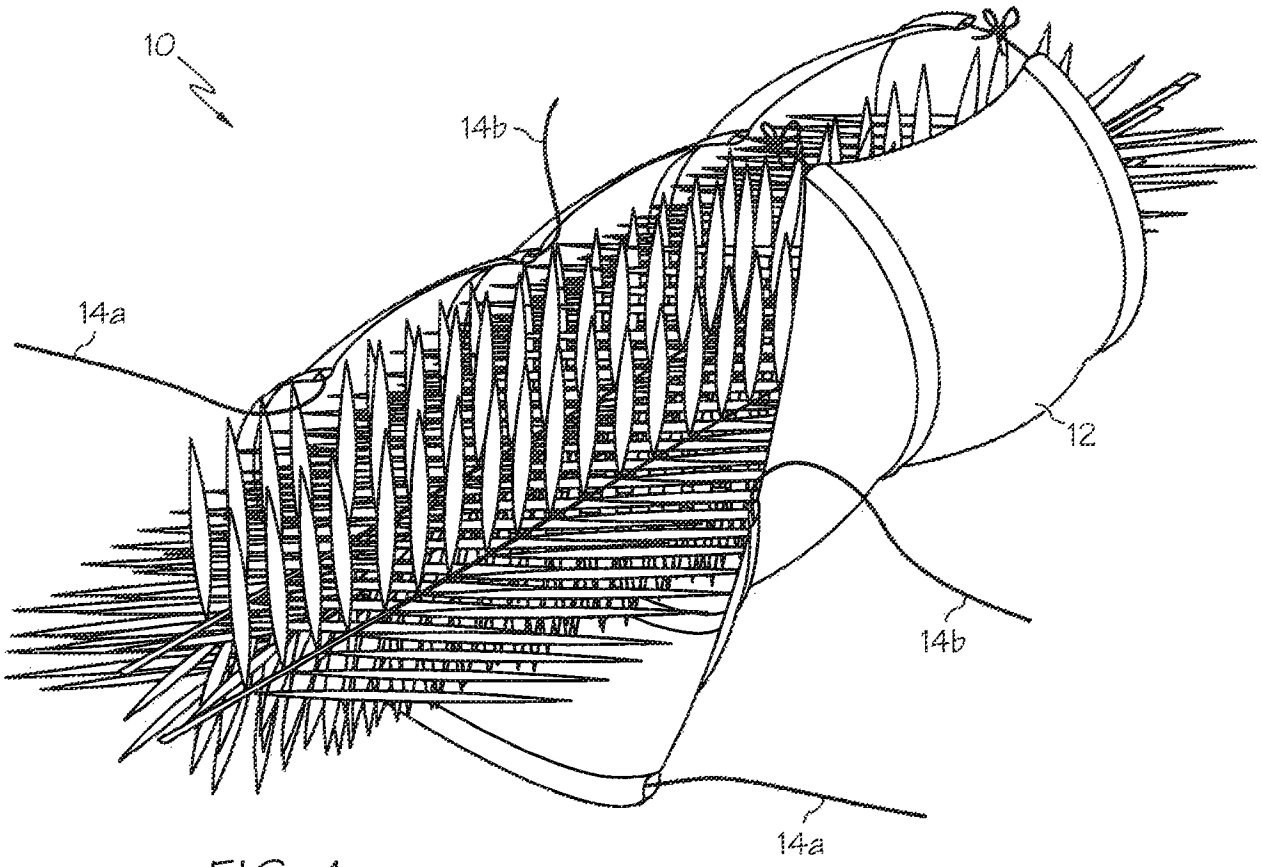
FIG. 4 is a top perspective view illustrating the bundling of the tree trimmings using the drawstrings.
Figure 5:
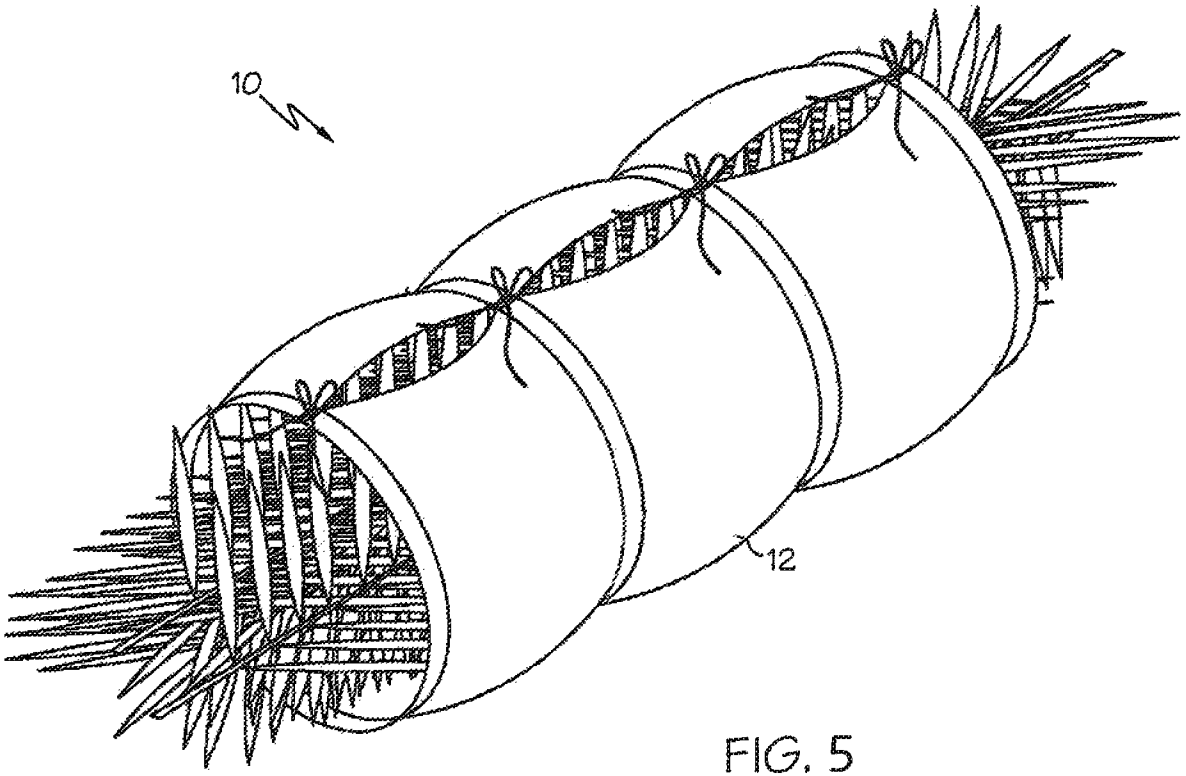
FIG. 5 is a top perspective view illustrating the wrap in contoured surrounding relation with the debris.

Wrap 10 of the present invention is used by (a) laying the main body sheet 12 generally flat on the ground with drawstrings 14*a* and 14*b* projecting from the opposing ends thereof as illustrated in FIGS. 1 and 2; (b) placing yard debris, such as tree trimmings, branches, and raked leaves on top of main body 12 as illustrated in FIG. 3; (c) pulling opposing drawstring ends together such that sheet 12 wraps around the debris in contoured surrounding relation therewith and securing the drawstring ends tied together as illustrated in FIGS. 4 and 5 to form a bundled load that is approximately 4 feet from end to end thereby conforming to popular trash collection requirements. Once bundled the debris may be lifted, using the tied drawstrings as handles, and placed for eventual collection and removal by trash collection service. Using the tied drawstrings as handles is considered significant as the drawstrings preferably have a higher tensile strength than the material forming sheet 12 and thus form handles of higher overall strength. As noted above, wrap 10 is formed with, or is adapted with, material having a high coefficient of static friction which facilitates stacking of a plurality of wrapped bundles in a stable pile by preventing relative movement between adjacently engaged bundles. Wrap 10 is preferably positioned in proximity to the work area and manually loaded with debris, such as tree trimmings, branches, leaves etc., in any suitable manner. In addition, wrap 10 may be positioned under a tree such that trimmings fall directly onto the openly deployed sheet 12.

Alternate Embodiments

The present invention may be embodied in several alternate embodiments. Among said alternate embodiments is a first alternate embodiment wherein sheet 12 of disposable wrap 10, is formed in versions having shorter or longer width dimensions. In accordance with this aspect of the present invention, sheet 12 may be formed with a width of between approximately 3.0 feet and approximately 5.0 feet so as to enable wrap 10 to be tailored to handle particularly sized loads. For example, in a first alternate embodiment, sheet 12 may be formed having a width of approximately 3.0 feet. This first alternate embodiment will produce a disposable wrap better suited for bundling smaller loads, such as tree and bush trimmings and minor yard debris. In a second alternate embodiment, sheet 12 may be formed having a width of approximately 5.0 feet. This second alternate embodiment will produce a disposable wrap better suited for bundling larger loads such as large tree branches. As should be apparent, sheet 12 may be sized in other embodiments to any suitable width dimensions between approximately 3.0 feet and 5.0 feet.

Figure 6:
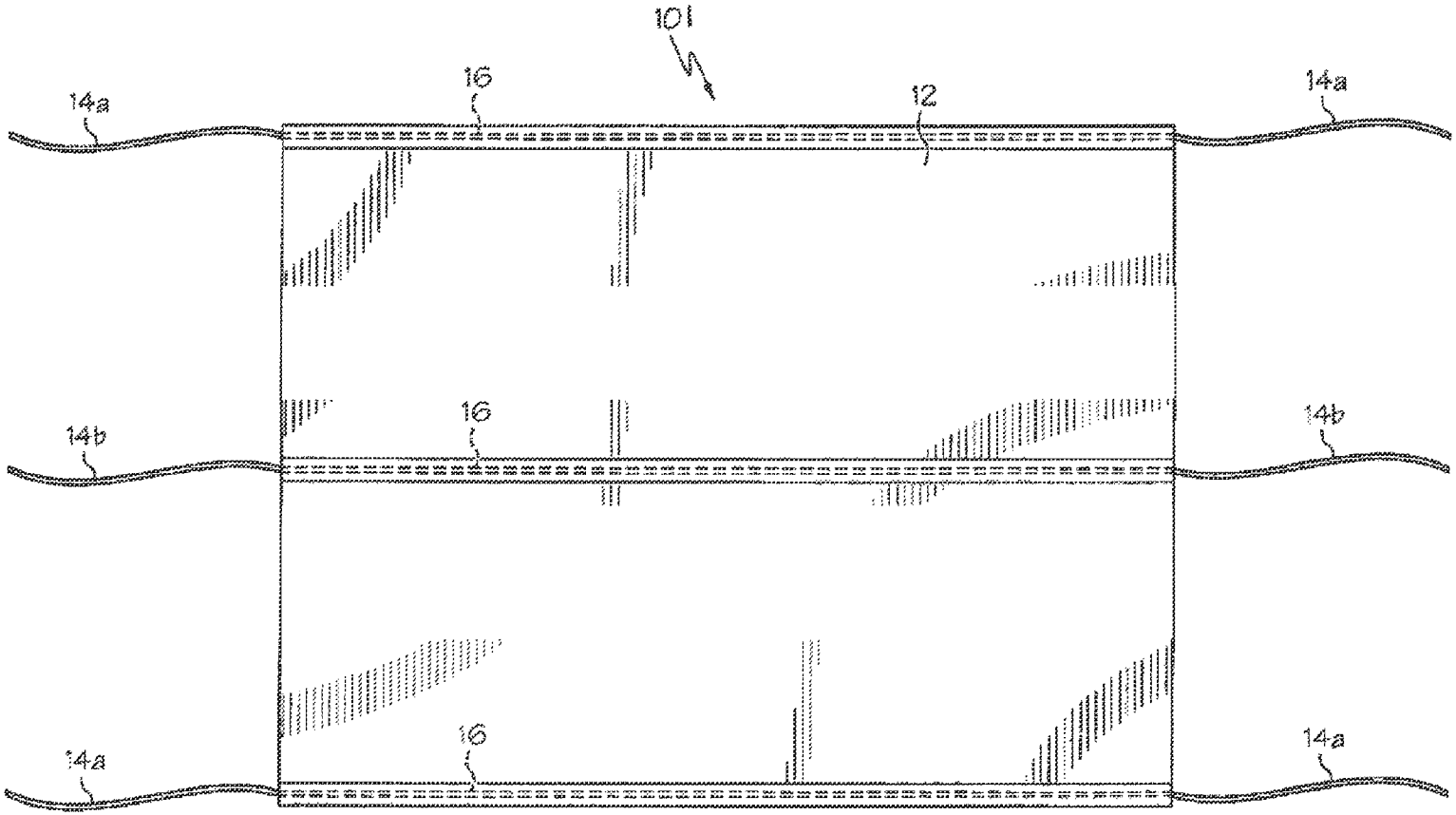
FIG. 6 is a top plan view of an alternate embodiment debris bundling wrap in accordance with the present invention.

FIG. 6 depicts another alternate embodiment disposable debris wrap, generally referenced as 101, characterized as having three drawstrings. As with the preferred embodiment, debris wrap 101 comprises a main body sheet 12 that may be fabricated in accordance with the materials and dimensions discussed herein above. Wrap 101 further includes a plurality of drawstrings referenced as 14*a* and 14*b*, with corresponding channels 16. Drawstrings 14*a* and 14*b* traverse the length of sheet 12 in generally parallel and spaced relation through separate sleeve-like hems or channels 16 formed on sheet 12 and extend beyond the opposing sides of sheet 12 as best illustrated in FIG. 6. The embodiment depicted in FIG. 6, includes three drawstrings including a pair of outer drawstrings, referenced as 14*a*, and a single inner drawstring, referenced as 14*b*, generally centrally disposed between drawstrings 14*a*. In yet another contemplated alternate embodiment, debris wrap 10 may be fitted with just two drawstrings, namely drawstrings 14*a*, by the elimination of drawstring 14*b*. Further drawstrings 14*a* may be inwardly spaced from the peripheral edge of sheet 12 in any of the embodiments disclosed herein.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A disposable yard debris bundling device comprising:

a rectangular disposable sheet-like main body having a width and a length, said length being equal to or exceeding said width;

a plurality of channels each of said channels disposed perpendicular to said width and in parallel spaced relation spanning the length of said main body;

said plurality of channels including at least two outer channels disposed at or near opposing peripheral side edges of said sheet, and a third channel generally centrally disposed between said at least two outer channels;

each of said channels having an elongate flexible drawstring partially received therein, in slidable relation therewith, with opposing ends projecting therefrom;

said sheet-like main body configurable between an open deployed configuration wherein said main body is openly disposed for receiving debris, and a closed bundled configuration wherein said main body is disposed in surrounding relation with the debris so as to bundle the debris in a generally tubular open-ended configuration, and wherein said tubular configuration is secured by opposing ends of each of said drawstrings tied together.

2. A disposable yard debris bundling device according to claim 1, wherein each of said drawstring projecting ends forms a loop.

3. A disposable yard debris bundling device according to claim 1, wherein said sheet-like main body is fabricated from high-strength, light-weight plastic.

4. A disposable yard debris wrap-type bundling device comprising:

a rectangular disposable sheet-like main body having a width and a length equal to or exceeding said width;

said main body defining at least three channels in parallel spaced relation spanning the length thereof;

said channels including a pair of outer channels disposed at or near opposing peripheral side edges of said sheet, and at least one inner channel disposed in inwardly spaced relation with said outer channels;

at least one elongate flexible drawstring partially movably received within each of said at least three channels with drawstring opposing ends projecting from each of said channels;

said sheet-like main body configurable between an open deployed configuration wherein said main body is openly disposed for receiving debris, and a closed bundled configuration wherein said main body is disposed in generally tubular surrounding relation with the debris so as to bundle the debris in a generally tubular configuration.

* * * * *